United States Patent [19]

Klarman

[11] 4,255,886

[45] Mar. 17, 1981

[54] ARTIST CANVAS STRETCHER FRAME BRACE BRACKET

[75] Inventor: Wallace Klarman, Lawrenceville, Ga.

[73] Assignee: Tara Materials, Inc., Lawrenceville, Ga.

[21] Appl. No.: 10,814

[22] Filed: Feb. 9, 1979

[51] Int. Cl.[3] ..... D06C 3/08

[52] U.S. Cl. ..... 38/102.3; 160/379

[58] Field of Search ..... 38/102, 102.1, 102.3–102.91; 160/378, 379; 52/665, 712, 713, 714; 248/300; 211/105, 123

[56] References Cited

U.S. PATENT DOCUMENTS

| | | | |
|---|---|---|---|
| 845,869 | 3/1907 | Gifford | 160/379 |
| 1,227,577 | 5/1917 | Brewer | 160/379 X |
| 1,285,973 | 11/1918 | Fredman | 160/379 X |
| 1,443,923 | 1/1923 | Nercam | 38/102.8 |
| 2,470,129 | 5/1949 | Bemis et al. | 160/379 X |
| 2,676,652 | 4/1954 | Duncan | 160/379 X |

*Primary Examiner*—Louis Rimrodt

*Attorney, Agent, or Firm*—Patrick F. Henry

[57] ABSTRACT

An artist canvas frame comprises the usual rectangular frame members attached at four corners and having a canvas stretched around the periphery and held in place by staples or some other suitable means. To improve the stability of the frame a brace is provided substantially midway transversely across the back of the frame in one or both directions and is held in place by movable plastic socket members on each respective end of the brace and each socket member comprises a small rectangular tube having opposed side members extending therefrom fitted over the inside faces of opposed frame members, known individually as stretcher strips or stretcher bars.

1 Claim, 5 Drawing Figures

ARTIST CANVAS STRETCHER FRAME BRACE BRACKET

BACKGROUND OF THE INVENTION

1. Field of the Invention

Artist canvas frames, picture frames and the like having braces or stretching devices incorporated therewith.

2. Description of the Prior Art

The usual artist canvas stretcher frame comprises a rectangular wooden frame connected together at the four corners as for example by a mortise joint and having a canvas stretched therearound with the respective edges of the canvas attached to the outside edges of the respective four frame members. The mitered corners of the frame may either be fixed and glued in place or nailed in place by corrugated nails or the like or may be mortised and permitted to have some amount of movement in order to respond to the variation in the tension on the canvas caused by changes in humidity. In certain instances where the canvas is stretched over a frame the changes in atmospheric conditions will cause the canvas to tighten and bow the frame members inwardly thereby causing a permanent bend in the frame. Such canvasses will not be suitable for sale and would be objectionable if the condition happens at the sale. The present invention is a simple solution to that problem and utilizes a pair of simple inexpensive plastic connecting devices or brackets to secure a brace member in the proper position.

SUMMARY OF THE INVENTION

A rectangular frame with connected and mitered corners has a fabric such as an artist canvas stretched thereover and attached thereto. A sliding brace is provided behind the fabric on the back of the frame and comprises a brace member having a small connector on each end thereof and each connector comprising an open socket movably receiving the brace member therein and opposed end members fitted around the inside of one of the opposed frame members so that the brace may be inserted and removed and is slidable in place.

An object of this invention is to provide a brace means for a frame having a fabric stretched thereon.

Another object of this invention is to provide a simple and expedient means of attaching a brace for selective positioning in the back of a frame having a fabric stretched thereover, such as an artist canvas frame.

An additional advantage in the present invention resides in the use of simple inexpensive brackets which may be manufactured from plastic or the like for use with inexpensive and lightweight wood pieces.

Other and further objects and advantages of the present invention will become apparent upon reading the following description of a preferred embodiment taken in conjunction with the accompanying drawings.

DESCRIPTION OF A PREFERRED EMBODIMENT

Figure 1:
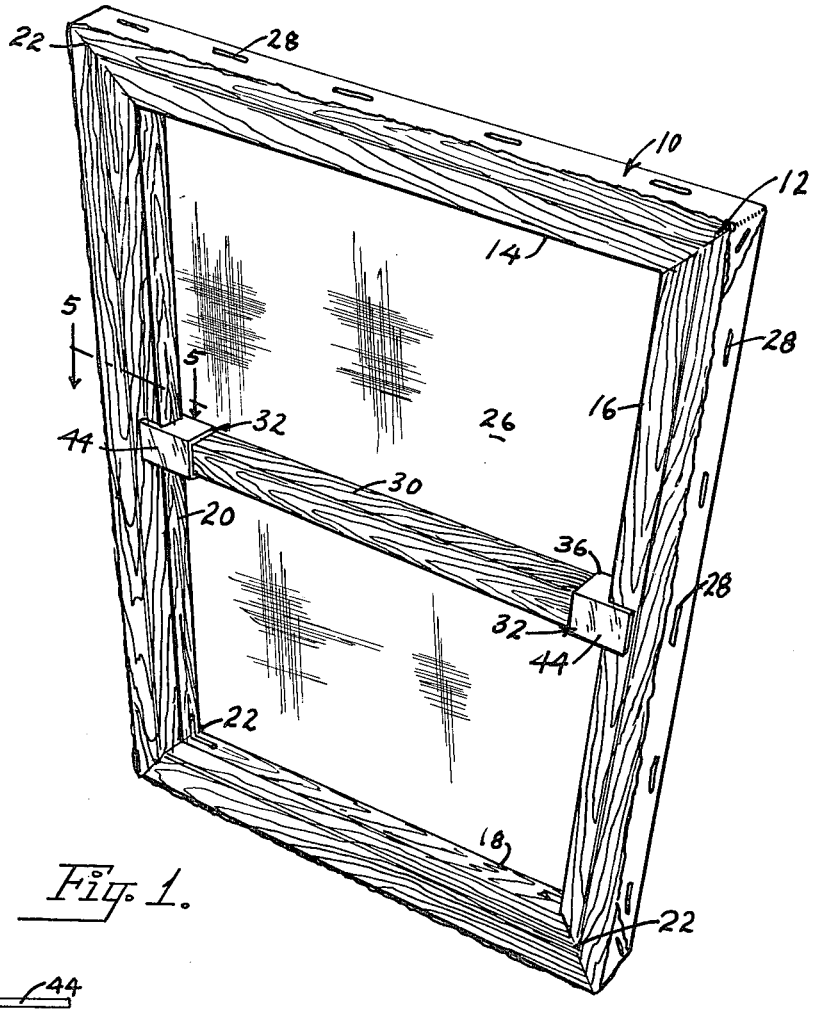
FIG. 1 is a perspective view of an artist frame with canvas stretched thereover and stapled in place and having the present brace means positioned behind the canvas on the frame.
Figure 2:
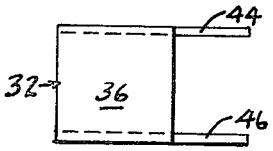
FIG. 2 is a top plan view of one of the connecting brackets.
Figure 5:
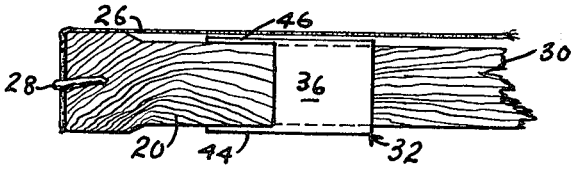
FIG. 5 is a cross-sectional view taken substantially along lines 5—5 in FIG. 1.
Figure 3:
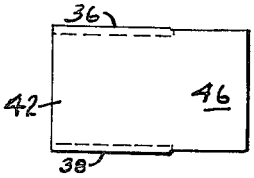
FIG. 3 is a side elevation view of the connecting bracket shown in FIG. 2.
Figure 4:
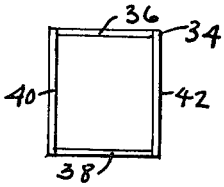
FIG. 4 is an end elevation view of the connecting brackets shown in FIG. 2.

A conventional artist canvas frame assembly 10 comprises a rectangular frame 12 consisting of four frame members 14, 16, 18 and 20 attached at the usual corners 22 by any well known method of corner connections such as mitered fixed corner which is glued or nailed in place or a mortise tenon joint wherein the end of one of the frame members such as 16 has the mortise or cavity therein to receive the tenon which is formed as a projection on members 14 and 18 and the same with the other ends of members 14 and 18 and the member 20. This is of conventional well known construction and some of the details thereof are not shown in the drawing. The fabric or specially treated artist canvas 26 is stretched around the rectangular frame 12 and fastened in place by staples or tacks 28 which are driven through the fabric 26 into the outer peripheral surfaces of all of the frame members 14, 16, 18 and 20 in the manner shown in FIG. 1. According to the usual practice the canvas fabric 26 is stretched tightly and smoothly and this places a certain amount of force on the respective frame members 14, 16, 18 and 20. Due to changes in humidity and therefore in the fabric 26 there is a change in the forces applied to the frame members 14 et al and therefore it is possible that abnormal stresses will occur which would cause the frame members on opposite sides such as 14, 18 or 16, 20 to bow in and permanently warp the frame. The same constricting effect is also caused by shrink film packaging of the individual stretched canvas when the film shrinks tighter than the frame 12 members can resist, thereby bending the frame 12 in the same manner.

A wooden brace 30 which may be cut to very close length between frame members 16, 20 has a respective connecting bracket 32 on each end thereof for insertion around the inside face of respective frame members 16, 20.

Bracket 32 is seen in FIGS. 2 thru 5, inclusive, and comprises a tubular, rectangular socket portion 34 having opposed side walls 36, 38, 40 and 42 and a pair of projecting side walls 44, 46 which form a slot in which is fitted the outside edge of the respective members 16, 20 in the manner shown in the drawings. Therefore, it is possible to insert the brace member 30 in place by first sliding a respective bracket 32 over the end of the brace 30, positioning the brace 30 in place between the respective frame members 16, 20 and then sliding the brackets 32 into position to place the spaced walls 44, 46 over the edge of the members 16, 20. Once the brace 30 is in position it is possible to slide the entire brace and the brackets 32 upwardly or downwardly and to make small and minor adjustments in the alignment of the brace 30 so as to bring it into proper parallel relationship with the top member 14 and the bottom member 18. Base 30 could also be applied in the other direction between members 14, 18 in the same manner.

While I have shown and described a particular embodiment of this invention together with a suggested mode of operation and use thereof this is by way of illustration only and does not constitute any sort of limitation on the scope since there are various alterations, changes, deviations, eliminations, additions and departures which may be made in the invention without avoiding the scope of the invention as defined in the appended claims.

What is claimed:

1. In a frame arrangement:

a rectangular frame comprising side frame members connected at respective corners, said frame being subject to expansion and contraction whereby said side frame members may move closer together or further apart in response to the environmental conditions, a fabric material such as artist-canvas, positioned on and attached to said frame along and between respective edges of the side frame members, said canvas being subject to expansion and contraction whereby said side frame members may be moved, a brace member positioned for movement on said frame concealed behind said fabric and extending between a pair of opposed side frame members for selective, manual movement therealong, said brace member having respective ends adjacent a respective side frame member, bracket means movably receiving and retaining the respective ends of the brace member therein for limited movement between said side frame members, said bracket means comprising individual brackets on each respective end of said brace member and each individual bracket having a closed tubular portion with a through opening therein for the respective ends of said brace member, said brackets each including spaced, side members thereon extending partly over the opposite sides of the respective side frame member to loosely retain each end of said brace member on said respective side frame member whereby said brace member is normally movable a limited amount in place between said opposed side frame members and without fasteners, such as screws, in the frame; whereby said brace member is not fastened or rigidly attached to said side frame member so that there is a small amount of limited movement, said brace thereby being adjustable along substantially the entire length of the respective side frame members but being prevented from disengagement therefrom.

* * * * *